US006202418B1

(12) United States Patent
Gabrielli et al.

(10) Patent No.: US 6,202,418 B1
(45) Date of Patent: Mar. 20, 2001

(54) MATERIAL SELECTION AND CONDITIONING TO AVOID BRITTLENESS CAUSED BY NITRIDING

(75) Inventors: Frank Gabrielli, South Windsor; Thomas B. Gibbons; Stephen L. Goodstine, both of Windsor; James K. O'Neill, Tolland, all of CT (US)

(73) Assignee: ABB Combustion Engineering, Windsor, CT (US)

( * ) Notice: Subject to any disclaimer, the term of this patent is extended or adjusted under 35 U.S.C. 154(b) by 0 days.

(21) Appl. No.: 09/229,366

(22) Filed: Jan. 13, 1999

(51) Int. Cl.[7] ..... F01K 25/06
(52) U.S. Cl. ..... 60/649; 60/651; 60/671
(58) Field of Search ..... 60/649, 651, 671; 165/181; 148/519

(56) References Cited

U.S. PATENT DOCUMENTS

| | | | | |
|---|---|---|---|---|
| 3,731,738 | * | 5/1973 | Cooper | 165/180 |
| 4,082,575 | | 4/1978 | Eastman | 148/6.35 |
| 4,489,563 | | 12/1984 | Kalina | 60/673 |
| 4,732,005 | | 3/1988 | Kalina | 60/673 |
| 4,950,552 | | 8/1990 | Amend et al. | 428/626 |
| 4,982,568 | | 1/1991 | Kalina | 60/649 |
| 5,029,444 | | 7/1991 | Kalina | 60/673 |
| 5,095,708 | | 3/1992 | Kalina | 60/673 |
| 5,440,882 | | 8/1995 | Kalina | 60/641.2 |
| 5,450,821 | | 9/1995 | Kalina | 122/1 |
| 5,572,871 | | 11/1996 | Kalina | 60/649 |
| 5,588,298 | | 12/1996 | Kalina et al. | 60/673 |
| 5,848,887 | * | 12/1998 | Zabielski et al. | 431/353 |
| 5,855,699 | * | 1/1999 | Oyama et al. | 148/519 |
| 5,960,870 | * | 10/1999 | Takahashi et al. | 165/181 |

FOREIGN PATENT DOCUMENTS

| | | |
|---|---|---|
| 0 708 295 A1 | 10/1995 | (EP) . |
| 01056356 | 3/1989 | (JP) . |
| 508 594 | 10/1998 | (SE) . |

OTHER PUBLICATIONS

Kalina Cycles for Efficient Direct Fired Application,–Alexander I. Kalina, Yakov Lerner, Richard I. Pelletier, Exergy, Inc., Lawrence J. Peletz, Jr. ABB CE systems, Combustion engineering, Inc., –7 pgs. (No Date).

Kalina Cycle Looks Good for Combined Cycle Generation–Dr. James C. Corman, Dr. Robert W. Bjorge, GE Power Systems, Dr. Alexander Kalina, Exergy, Inc., Jul., 1995–3 pgs.

Power Perspective, The Kalina Cycle–More Electricity From Each BTU of Fuel–1995–3 pgs.

A Gas Turbine–Aqua Ammonia Combined Power Cycle–Irby Hicks, The Thermosorb Company–Mar. 25, 1996–6 pgs.

Understanding the Kalina Cycle Fundamentals–H.A. Mlcak, P.E., ABB Lummus Crest–12 pgs (No Date).

Direct–Fired Kalina Cycle: Overview–ABB–1994–13 pgs.

Kalina Cycle System Advancements for Direct Fired Power Generation, Michael J. Davidson, Lawrence J. Peletz, ABB Combustion Engineering,–9 pgs (No Date).

(List continued on next page.)

*Primary Examiner*—Hoang Nguyen
(74) *Attorney, Agent, or Firm*—Alfred A. Stadnicki

(57) ABSTRACT

A system for changing the temperature of a working fluid, including amonia, includes a working fluid source and a steel tube. The working fluid source is configured to direct a flow of the working fluid. The working fluid from the source is at a temperature. The steel tube has a treated inner surface layer defining a flow passage. The surface may comprise a mill finish surface, an oxidizing surface and/or a chromized surface. The tube is configured to receive the working fluid from the source and to direct the flow of the received working fluid along a path to change the temperature of the received working fluid.

20 Claims, 10 Drawing Sheets

OTHER PUBLICATIONS

Kalina Cycles and System for Direct–Fired Power Plants, A.I. Kalina, Exergy, Inc., AES–vol. 25/HTD–vol. 191–7 pgs (No Date).

Masato Taki, et al. "Experimental Study on Rankine Cycle Using Ammonia–Water Mixture as a Working Fluid" Proceedings of the Intersociety Energy Conversion Engineering Conference, vol. Conf 27, Aug. 3, 1992, pp. 3.25–3.34, XP000392714, US San Diego.

N G Zervos, Stone & Webster Engineering Corp., H M Leibowitz, Exergy Inc., and K. Robinson, Rockwell International corp. "Innovative Kalina Cycle Promises High Efficientcy", Developments to Watch, Apr., 1992, New York, US, pp. 177–179.

* cited by examiner

MATERIAL SELECTION AND CONDITIONING TO AVOID BRITTLENESS CAUSED BY NITRIDING

CROSS-REFERENCE TO RELATED APPLICATIONS

The present application relates to pending U.S. patent application Ser. No. 09/231,165, filed Jan. 13, 1999, for "TECHNIQUE FOR CONTROLLING REGENERATIVE SYSTEM CONDENSATION LEVEL DUE TO CHANGING CONDITIONS IN A KALINA CYCLE POWER GENERATION SYSTEM"; U.S. patent application Ser. No. 09/231,171, filed Jan. 13, 1999, for "TECHNIQUE FOR BALANCING REGENERATIVE REQUIREMENTS DUE TO PRESSURE CHANGES IN A KALINA CYCLE POWER GENERATION SYSTEM"; U.S. patent application Ser. No. 09/229,364, filed Jan. 13, 1999, for "TECHNIQUE FOR CONTROLLING SUPERHEATED VAPOR REQUIREMENTS DUE TO VARYING CONDITIONS IN A KALINA CYCLE POWER GENERATION SYSTEM"; U.S. patent application Ser. No. 09/231,166, filed Jan. 13, 1999, for "TECHNIQUE FOR MAINTAINING PROPER DRUM LIQUID LEVEL IN A KALINA CYCLE POWER GENERATION SYSTEM"; U.S. patent application Ser. No. 09/229,629, filed Jan. 13, 1999, for "TECHNIQUE FOR CONTROLLING DCSS CONDENSATE LEVELS IN A KALINA CYCLE POWER GENERATION SYSTEM"; U.S. patent application Ser. No. 09/229,630, filed Jan. 13, 1999, for "TECHNIQUE FOR MAINTAINING PROPER FLOW IN PARALLEL HEAT EXCHANGERS IN A KALINA CYCLE POWER GENERATION SYSTEM"; U.S. patent application Ser. No. 09/229,631, filed Jan. 13, 1999, for "TECHNIQUE FOR MAINTAINING PROPER VAPOR TEMPERATURE AT THE SUPERHEATER/REHEATER INLET IN A KALINA CYCLE POWER GENERATION SYSTEM"; U.S. patent application Ser. No. 09/231,164, filed Jan. 13, 1999, for "WASTE HEAT KALINA CYCLE POWER GENERATION SYSTEM"; U.S. patent application Ser. No. 09/231,168, filed Jan. 13, 1999, for "REFURBISHING CONVENTIONAL POWER PLANTS FOR KALINA CYCLE OPERATION"; U.S. patent application Ser. No. 09/231,170, filed Jan. 13, 1999, for "STARTUP TECHNIQUE USING MULTIMODE OPERATION IN A KALINA CYCLE POWER GENERATION SYSTEM"; U.S. patent application Ser. No. 09/231,163, filed Jan. 13, 1999, for "TECHNIQUE FOR COOLING FURNACE WALLS IN A MULTI-COMPONENT WORKING FLUID POWER GENERATION SYSTEM"; U.S. patent application Ser. No. 09/229,632, filed Jan. 13, 1999, for "BLOWDOWN RECOVERY SYSTEM IN A KALINA CYCLE POWER GENERATION SYSTEM"; U.S. patent application Ser. No. 09/229,368, filed Jan. 13, 1999, for "REGENERATIVE SUBSYSTEM CONTROL IN A KALINA CYCLE POWER GENERATION SYSTEM"; U.S. patent application Ser. No. 09/229,363, filed Jan. 13, 1999, for "DISTILLATION AND CONDENSATION SUBSYSTEM (DCSS) CONTROL IN A KALINA CYCLE POWER GENERATION SYSTEM"; U.S. patent application Ser. No. 09/229,365, filed Jan. 13, 1999, for "VAPOR TEMPERATURE CONTROL IN A KALINA CYCLE POWER GENERATION SYSTEM"; U.S. patent application Ser. No. 09/229,367, filed Jan. 13, 1999, for "A HYBRID DUAL CYCLE VAPOR GENERATOR"; U.S. patent application Ser. No. 09/231,169, filed Jan. 13, 1999, for "FLUIDIZED BED FOR KALINA CYCLE POWER GENERATION SYSTEM"; U.S. patent application Ser. No. 09/231,167, filed Jan. 13, 1999, for "TECHNIQUE FOR RECOVERING WASTE HEAT USING A BINARY WORKING FLUID".

FIELD OF THE INVENTION

The present invention relates generally to the selection and conditioning of materials to avoid brittleness caused by NITRIDING. More specifically, the present invention relates to selection and conditioning of materials exposed to an environment containing ammonia, such as materials exposed to ammonia/water working fluids within a Kalina cycle power generation plant.

BACKGROUND OF THE INVENTION

In recent years, industrial and utility concerns with deregulation and operational costs have strengthened demands for increased power plant efficiency. The Rankine cycle power plant, which typically utilizes water as the working fluid, has been the mainstay for the utility and industrial power industry for the last 150 years. In a Rankine cycle power plant, heat energy is converted into electrical energy by heating a working fluid flowing through tubular walls, commonly referred to as waterwalls, to form a vapor, e.g. turning water into steam. Typically, the vapor will be superheated to form a high pressure vapor, e.g., superheated steam. The high pressure vapor is used to power a turbine/generator to generate electricity.

Conventional Rankine cycle power generation systems can be of various types, including direct-fired, fluidized bed and waste-heat type systems. In direct fired and fluidized bed type systems, combustion process heat is generated by burning fuel to heat the combustion air which in turn heats the working fluid circulating through the systems' waterwalls. In direct-fired Rankine cycle power generation systems the fuel, commonly pulverized-coal, gas or oil, is ignited in burners located in the waterwalls. In bubbling fluidized bed Rankine cycle power generation systems pulverized-coal is ignited in a set in a bed located at the base of the boiler to generate combustion process heat. Waste-heat Rankine cycle power generation systems rely on heat generated in another process, e.g., incineration, for process heat to vaporize, and if desired superheat, the working fluid. Due to the metallurgical limitations, the highest temperature of the superheated steam does not normally exceed 1050° F. (566° C.). However, in some "aggressive" designs, this temperature can be as high as 1100° F. (593° C.).

Waterwalls are formed of tubes which serve as flow passages for the working fluid. Hence, the waterwalls must be capable of being subjected to the pressure loads generated by the working fluid throughout the cycle. Typically, the waterwalls must also be capable of being subjected to other loads. For example, in many cases the waterwalls must be self supporting. It is also common for the waterwalls to have mounted in supported relation thereon other system elements, such as burners, a lower drum, and/or sootblowers. Accordingly, it is important that the waterwalls have the structural integrity to withstand the required loadings throughout a desired design life.

The waterwall tubes are conventionally made of steel. In a typical Rankine cycle power system, the waterwall tubes in those portions of the system which are subjected to lower temperatures may be of one type of steel while the waterwall tubes in higher temperature portions of the system are of a different type steel. Thus, the waterwall tubes in the lower temperature areas may be formed of low alloy steel, commonly referred to as ferritic steel, for example, having 2½Cr to 16Cr. Waterwall tubes in the higher temperature areas may be formed of high alloy steel, commonly referred to as austenitic or stainless steel, for example having 18Cr and 8Ni.

Over the years, efficiency gains in Rankine cycle power systems have been achieved through technological improvements which have allowed working fluid temperatures and pressures to increase and exhaust gas temperatures and pressures to decrease. An important factor in the efficiency of the heat transfer is the average temperature of the working fluid during the transfer of heat from the heat source. If the temperature of the working fluid is significantly lower than the temperature of the available heat source, the efficiency of the cycle will be significantly reduced. This effect, to some extent, explains the difficulty in achieving further gains in efficiency in conventional, Rankine cycle-based, power plants.

In view of the above, a departure from the Rankine cycle has recently been proposed. The proposed new cycle, commonly referred to as the Kalina cycle, attempts to exploit the additional degree of freedom available when using a binary fluid, more particularly an ammonia/water mixture, as the working fluid. The Kalina cycle is described in the paper entitled: "Kalina Cycle System Advancements for Direct Fired Power Generation", co-authored by Michael J. Davidson and Lawrence J. Peletz, Jr., and published by Combustion Engineering, Inc. of Windsor, Conn. Efficiency gains are obtained in the Kalina cycle plant by reducing the energy losses during the conversion of heat energy into electrical output.

A simplified conventional direct-fired Kalina cycle power generation system is illustrated in FIG. 1 of the drawings. Kalina cycle power plants are characterized by three basic system elements, the Distillation and Condensation Subsystem (DCSS) 100, the Vapor Subsystem (VSS) 110 which includes the boiler 142, superheater 144 and recuperative heat exchanger (RHE) 140, and the turbine/generator subsystem (TGSS) 130. The boiler 142 is formed of tubular walls 142*a* and the superheater 144 is formed of tubular walls 144*a*. A heat source 120 provides process heat 121. A portion 123 of the process heat 121 is used to vaporize the working fluid in the boiler 142. Another portion 122 of the process heat 121 is used to superheat the vaporized working fluid in the superheater 144.

FIG. 1A depicts an expanded view of the boiler tubular walls 142*a* through which the working fluid flows. As shown, the tubular walls 142*a* are formed of steel tubes 150. As is customary in Rankine cycle power systems, the tubes 150 have milled inner surfaces 155. FIG. 1B depicts an expanded view of the superheater tubular walls 144*a* through which the vaporized working fluid flows. As shown, the tubular walls 144*a* are formed of steel tubes 160. The tubes 160 also have conventional milled inner surfaces 165. Those skilled in the art will recognize that the tubes similar to those forming the tubular walls are also utilized to transport the working fluid in other components of the VSS 110, the TGSS 130 and the DCSS 100.

During normal operation of the Kalina cycle power system of FIG. 1, the ammonia/water working fluid is fed to the boiler 142 from the RHE 140 by liquid stream FS 5 and by liquid stream FS 7 from the DCSS 100. The working fluid is vaporized, i.e. boiled, in the tubular walls 142*a* of the boiler 142. The vaporized working fluid from the boiler 142, along with working fluid vaporized in the RHE 140, is further heated in the tubular walls 144*a* of the superheater 144. The superheated vapor, identified as FS vapor 40 is directed to and powers the TGSS 130 so that electrical power 131 is generated to meet the load requirement.

The expanded working fluid FS extraction 11 egresses from the TGSS 130, e.g., from a low pressure (LP) turbine (not shown) within the TGSS 130, and is directed to the DCSS 100. The expanded working fluid is, in part, condensed in the DCSS 100. Condensed working fluid, as described above, forms feed stream FS 7 to the boiler 142. The DCSS 100 also separates the expanded working fluid into an ammonia rich working fluid flow FS rich 20 and an ammonia lean working fluid flow FS lean 30. Waste heat 101 from the DCSS 100 is dumped to a heat sink, such as a river or pond.

The rich and lean flows 20, 30 respectively, are fed to the RHE 140. Another somewhat less expanded hot working fluid FS extraction 10 egresses from the TGSS 130, e.g., from a high pressure (HP) turbine (not shown) within the TGSS 130, and is directed to the RHE 140. Heat transferred from the expanded working fluid FS extraction 10 to the rich flow FS rich 20, vaporizes the FS rich flow 20 and condenses, at least in part, the expanded working fluid stream FS extraction 10, in the RHE 140. The vaporized rich flow is fed to the superheater 144 along with vaporized feed fluid from the boiler 142. The condensed expanded working fluid forms part of the feed flow, i.e., flow FS 5, to the boiler 142, as has been previously described.

As discussed above, unlike Rankine cycle power systems which typically utilize water as the working fluid, Kalina cycle power generation systems utilize a mixture of ammonia and water as the working fluid. When materials, such as steel, are exposed to environments containing ammonia at a high temperature, such as the vaporized working fluid in a Kalina type power generation system, dissociation of the ammonia may occur due to the catalytic reaction at the surface of the material. Hence in a Kalina cycle power generation system, such a reaction can occur at the surface of the steel tubular walls of the boiler 142 and the superheater 144, as well as other areas of the system subjected to the binary working fluid. The nitrogen formed in this process may cause nitriding of the fluid walls. Materials subjected to nitriding are known to become brittle.

FIG. 2 depicts a cross section of a conventional superheater tube 160 of the superheater 144 of the FIG. 1 Kalina cycle power system. If the tube is formed of the austenitic steel having 18Cr and 8Ni, as in a conventional Rankine cycle superheater, the inner milled surface 165 forming the flow passage for the Kalina cycle system working fluid will, after being exposed to the ammonia/water working fluid will become degraded due to the nitriding. As will be understood by those skilled in the art, this tubular wall tubing degradation could result in the tubular walls having insufficient structural integrity to withstand the required loadings throughout the desired system design life, typically 20 years or more.

FIG. 3 depicts a cross-section of a conventional boiler tube 150 of the boiler 142 of the FIG. 1 Kalina cycle power system. The tube, as discussed above is formed of ferritic steel having 2½–16Cr and 1Mo. Using conventional nitride testing procedures, the tube 150, after being exposed to the ammonia/water working fluid, the tube 150, has as shown in FIG. 3, a hardened layer 157 formed within the tube wall 159 due to nitriding. Hence, it is conventionally assumed that this fluid wall tubing degradation due to nitriding could result in the fluid walls becoming brittle and, therefore, having insufficient structural integrity to withstand the required loadings throughout the desired design life of the FIG. 1 power system.

The results of the conventional testing of the boiler tube 150 are shown in FIGS. 4A and 4B. More particularly, the depth and hardness of the nitride layer 157 shown in FIG. 3 are as shown in FIGS. 4A–B.

If the tube 150 is formed of a ferritic steel having a chromium content of 9%, as in a conventional Rankine cycle power system, and the tube is conventionally tested for nitriding, the expected hardness and hence brittleness of the nitride layer 157 of FIG. 3 will be much greater than 900 Vickers and the depth of the nitride layer after 1000 hours will be much greater than 100 microns. Such a hard nitride layer formed in the wall 159 of the tube 150 over such a substantial depth during such a short duration indicates that during a practical system design life, such nitriding would likely degrade the structural integrity of the tube such that it would be unable to withstand the required loading of the boiler walls over the design life.

If the chromium content of the tube 150 is reduced to 2½%, as indicated in FIG. 4B, and the tube is conventionally tested, the hardness and hence brittleness of the nitride layer 157 shown in FIG. 3 is reduced but still remains well over 300 Vickers; however, the depth of the nitride layer after 1000 hours is substantially increased to well over 500 microns. Here again, such a hard nitride layer formed in the wall 159 of the tube 150 over such a substantial depth and formed during such a short period indicates that nitriding during a practical system design life would very likely result in such degradation to the structural integrity of the tube that it would be insufficient to withstand the required loading of the boiler walls over the desired design life. Accordingly, it is generally accepted, based upon conventional testing, that the nitriding of ferritic steel tubes 150 of the type conventionally used in Rankine cycle boilers, will be unsuitable for practical Kalina cycle boilers.

FIG. 5 depicts a cross-sectional view of a tube 350 formed of mild steel. As indicated in FIG. 5, when the mild steel tube 350 is tested conventionally at ambient pressure, a nitride layer 357 forms below the ammonia contact surface 355 of the tube wall 359. Based upon this conventional testing it seems very likely that nitriding of mild steel tubes when subjected to the working fluid of a Kalina cycle power generation system could result in such degradation to the structural integrity of the tube that the tube would be unable to withstand the required loading of, for example, the boiler walls over the desired design life of a practical power generation system. Accordingly, it is generally accepted, based upon conventional testing, that because of nitriding mild steel tubes will be unsuitable for practical Kalina cycle boilers.

OBJECTIVES OF THE INVENTION

Accordingly, it is an object of the present invention to provide a technique for avoiding the unacceptable degradation of steel components exposed to a nitriding environment.

It is a further object of the present invention to provide a technique for avoiding the unacceptable degradation of steel power system components, such as the tubular walls, in a Kalina cycle type power system.

It is yet another object of the present invention to provide a technique for selecting steel power system components, such as flow tubes in a Kalina cycle type power system, such that unacceptable degradation of the components due to nitriding is avoided.

Additional objects, advantages, novel features of the present invention will become apparent to those skilled in the art from this disclosure, including the following detailed description, as well as by practice of the invention. While the invention is described below with reference to a preferred embodiment(s), it should be understood that the invention is not limited thereto. Those of ordinary skill in the art having access to the teachings herein will recognize additional implementations, modifications, and embodiments, as well as other fields of use, which are within the scope of the invention as disclosed and claimed herein and with respect to which the invention could be of significant utility.

SUMMARY OF THE INVENTION

In accordance with the invention, a system is provided for transferring heat to a fluid which includes ammonia. The fluid may, for example, be the binary ammonia/water working fluid of a Kalina cycle power generation system. The system includes a fluid source and one or more steel tubes. The fluid source directs the flow of the fluid at a particular temperature. Based upon this temperature, the fluid flowing from the source may be in a liquid, vapor or mixed vapor/liquid state. Each steel tube has a flow passage, i.e., a preferably enclosed area through which the fluid can flow, defined by a treated inner surface of the tube. The tube receives the fluid from the source and directs the flow of the fluid along a path exposed to heat to change, i.e., either increase or decrease, the temperature of the received fluid.

The source can be virtually any type of component through which a fluid flow can be directed. For example, the source could be an inlet to the boiler tubular walls of a Kalina cycle power generation system which receives the liquid or mixed state working fluid from the DCSS or RHE. The source could also be the boiler in its capacity as feed fluid source for the superheater in such a power generation system. The source might be the DCSS in its capacity as a feed fluid source for the RHE of a Kalina cycle power generation system.

The steel tubes may be formed of an alloy steel, such as an austenitic or ferritic steel, but could also be formed of mild steel in some cases. If formed of austenitic steel, it may be beneficial to use steel having up to 18Cr and 8Ni. If the tubes are formed of a ferritic steel, it is preferable for the steel to include 2½ to 16Cr and 1Mo. A number of the tubes may be used to form the boiler or superheater tubular walls of a Kalina cycle power generation system if so desired. It should be recognized that the term "tube" is used generally and includes any type of steel element which has a flow passage. Hence, each tube can be of any desired shape or form.

According to other aspects of the invention, the inner surface of each tube is treated by polishing, oxidizing and/or chromizing the inner surface of each tube, which is typically first formed with a mill finish. In this regard, the tube may be fabricated by first forming a steel member having a mill finish surface. This surface is the surface to be contacted by the nitriding environment, typically the inner surface of the tube. The surface is treated either prior to or after forming the steel member into a tubular element. For example, the surface may be polished or a chromium or oxide layer may be formed on the surface before or after the steel member is configured into a tube. Further, except in the case of an oxidation layer, the treatment of the surface will most often be performed prior to the plurality of tubes being installed, and, in any event, before the tubes are placed in service and used to direct the flow of the fluid. The chromium layer will preferably have a concentration in the range of 30% to 50% chromium. It should be noted that using such a chromium layer, virtually no degradation of the steel tubes due to nitriding will be experienced in areas of a Kalina cycle power system operating at a working fluid temperature of approximately 565° C. and a pressure of approximately 180 bar. This remains true for working fluids up to approximately 650° C.

Where the surface is to be oxidized, an oxide layer may be formed prior to or after the tube is actually placed in service or operation. That is the contact surface may be pre-treated to form the oxide layer prior to the passage of the flow of the fluid through the tube or the oxide layer could be formed on the contact surface while the flow of the nitriding fluid is passing through the tube, so long as oxygen is present. Because the quality of the oxide layer and hence the layer's ability to reduce the effects of nitriding on tubes directing the fluid flow will depend on the concentration of chromium in the tube, advantageously, the concentration of the chromium within the steel member, which is used to form the tube, is based upon a desired quality of the oxide layer that will be formed on the inner surface of the tube.

The different treatments may be used separately or in combination and/or for different components in the same system. For example, multiple austenitic steel tubes with polished and/or chromized inner surfaces might be used for the superheater of a Kalina cycle power generation system, while another group of multiple non-austenitic, e.g., ferritic, steel tubes with untreated or otherwise treated inner surfaces might be used for the boiler of the same system. In such a system, the non-austenitic steel tubes making up the boiler will direct the flow of the working fluid along a path so as to vaporize the fluid and feed the vaporized fluid to the austenitic steel tubes making up the superheater. The superheater tubes will then direct the flow of the vaporized working fluid along a path so as to superheat the vaporized fluid, e.g., by increasing the temperature of the received vaporized working fluid to a temperature exceeding 500° C., at a pressure preferably exceeding 100 bar. A turbine will typically receive and expand the superheated vaporized working fluid to generate power.

In accordance with another aspect of the invention, where the fluid from the source has a pressure substantially greater than ambient pressure, mild steel flow tubes, having untreated inner surfaces, can be utilized to direct the fluid flow. So long as the fluid remains at a pressure significantly greater than ambient pressure, e.g., above 100 bar, the tubes will not suffer significant degradation due to nitriding, even though the inner contact surface defining the flow passage is untreated. For example, mild steel tubes can be used in those areas of a Kalina cycle power generation system where the working binary fluid has a temperature up to 100° C. and a pressure exceeding 100 bar without significant degradation due to nitriding. Untreated mild steel tubes can also be utilized in those areas of a Kalina cycle power system having working fluid at approximately 500° C. and approximately 180 bar.

DETAILED DESCRIPTION OF THE INVENTION

Figure 1:
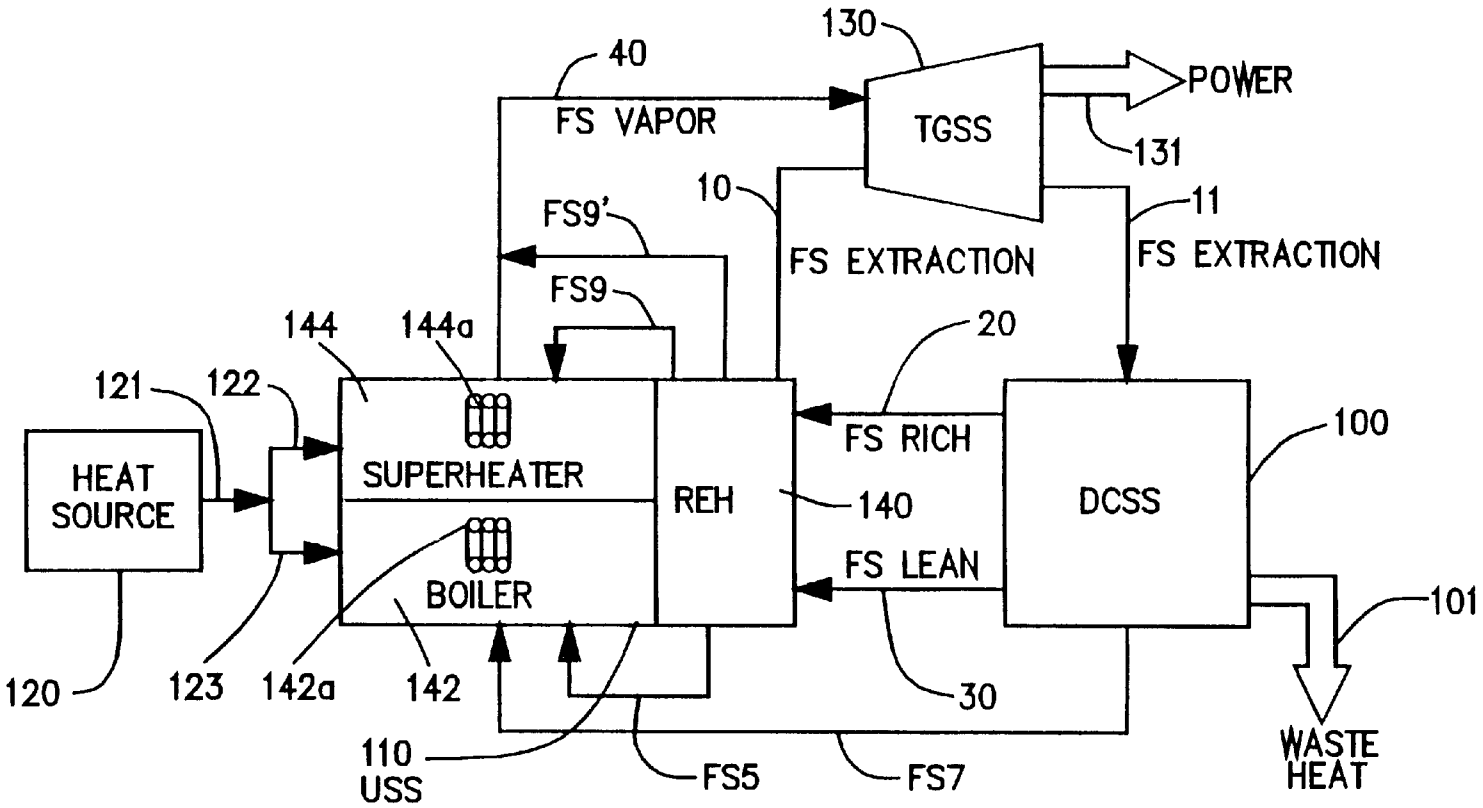
Figure 1 (PRIOR ART)
FIG. 1 is a simplified depiction of a conventional Kalina cycle power generation system.
Figure 1B:
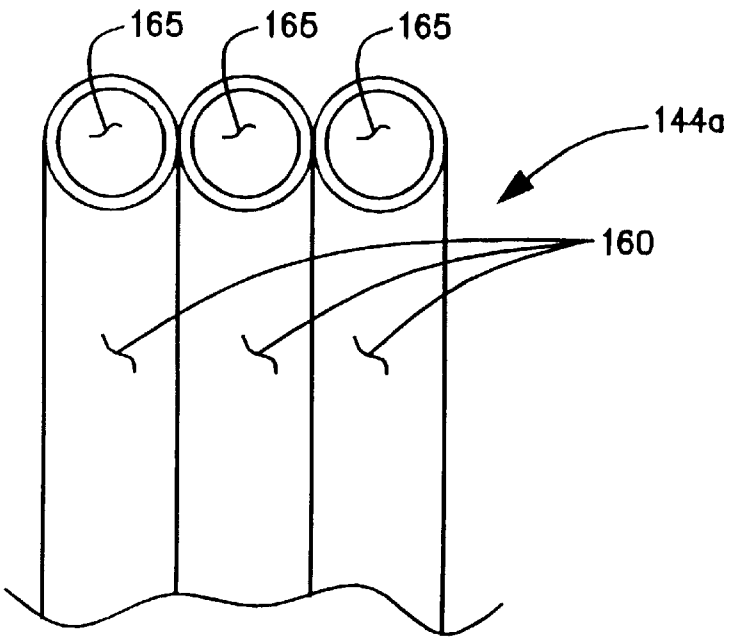
Figure 1B (PRIOR ART)
FIG. 1B details the tubular walls of the conventional Kalina cycle superheater shown in FIG. 1.
Figure 1A:
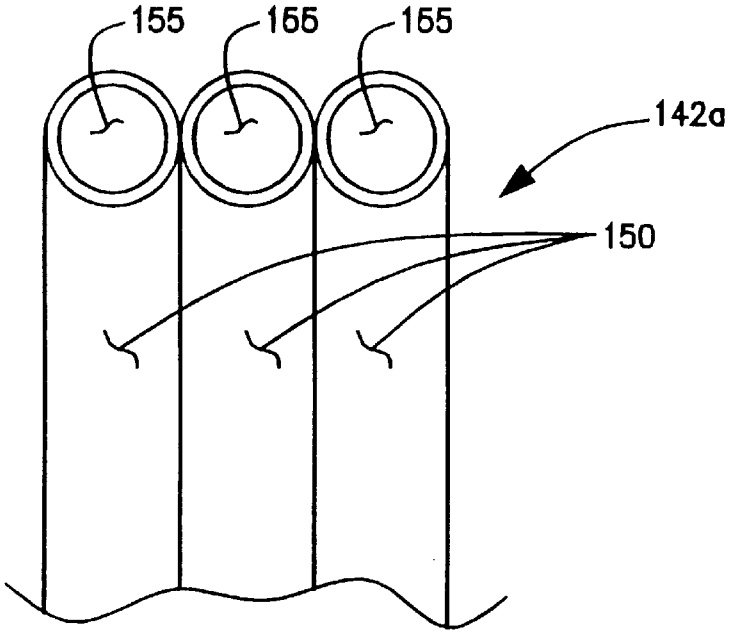
Figure 1A (PRIOR ART)
FIG. 1A details the tubular walls of the conventional Kalina cycle boiler shown in FIG. 1.
Figure 3:
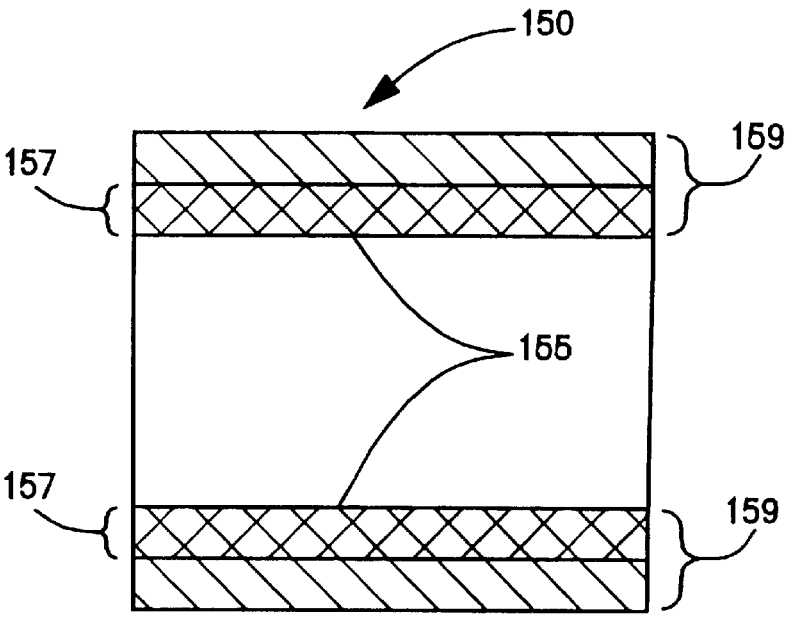
Figure 3 (PRIOR ART)
FIG. 3 depicts a cross section of a tube of a conventional boiler tubular wall tube shown in FIG. 1B, with the inner surface of the tube having a hard layer formed by exposure to an ammonia/steam environment of the type found in a Kalina cycle boiler.
Figure 2:
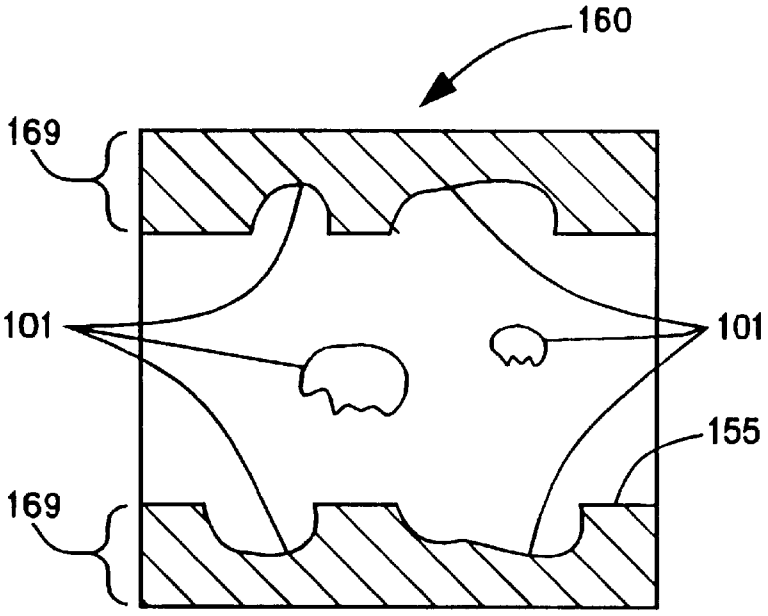
Figure 2 (PRIOR ART)
FIG. 2 depicts a cross section of a tube of the conventional superheater tubular wall shown in FIG. 1A, with the inner surface of the tube degraded as a result of nitriding.
Figure 4B:
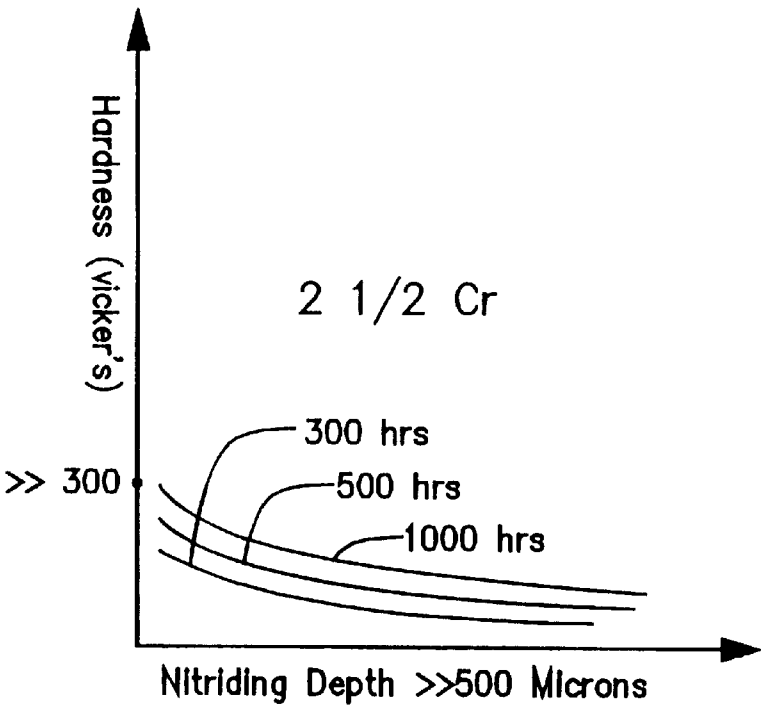
Figure 4B (PRIOR ART)
FIG. 4B depicts the depth of the hard layer formed due to nitriding within the wall of a ferritic steel tube of FIG. 3 having 2½Cr.
Figure 4A:
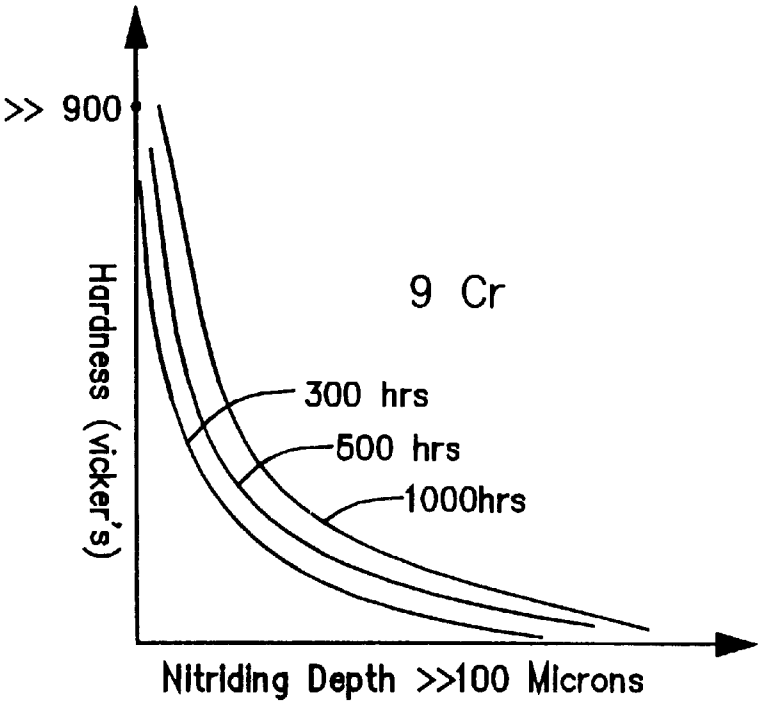
Figure 4A (PRIOR ART)
FIG. 4A depicts the depth of the hard layer formed due to nitriding within the wall of a ferritic steel tube of FIG. 3 having 9Cr.
Figure 5:
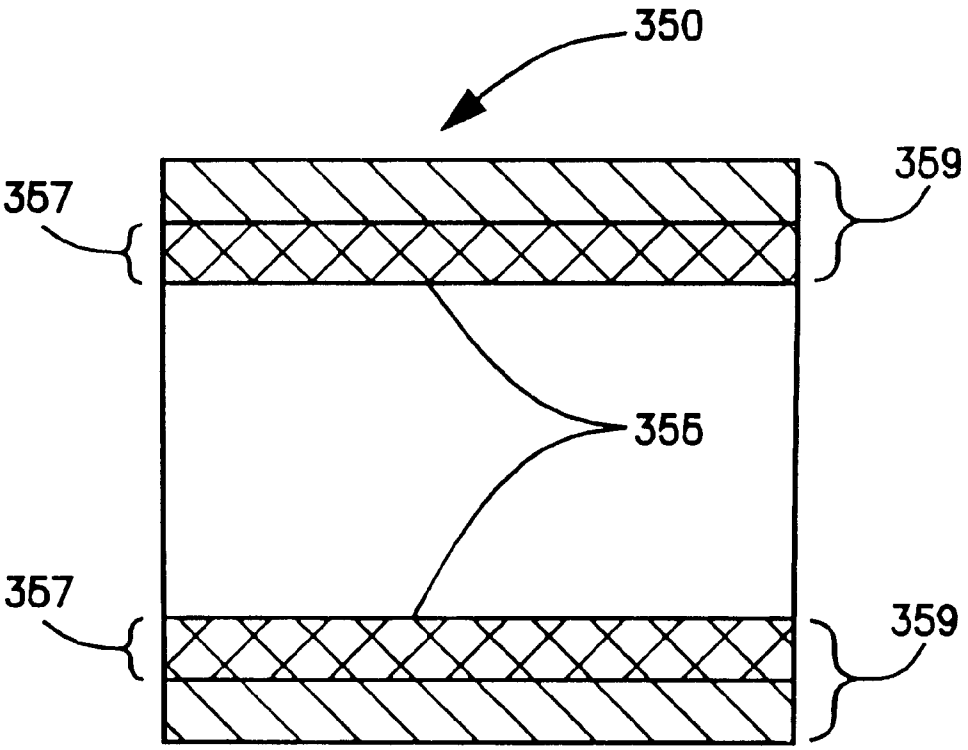
Figure 5 (PRIOR ART)
FIG. 5 depicts a cross section of a mild steel tube, with an inner surface of the tube having a hard layer formed by exposure to an ammonia/steam environment of the type found in a Kalina cycle boiler.
Figure 6:
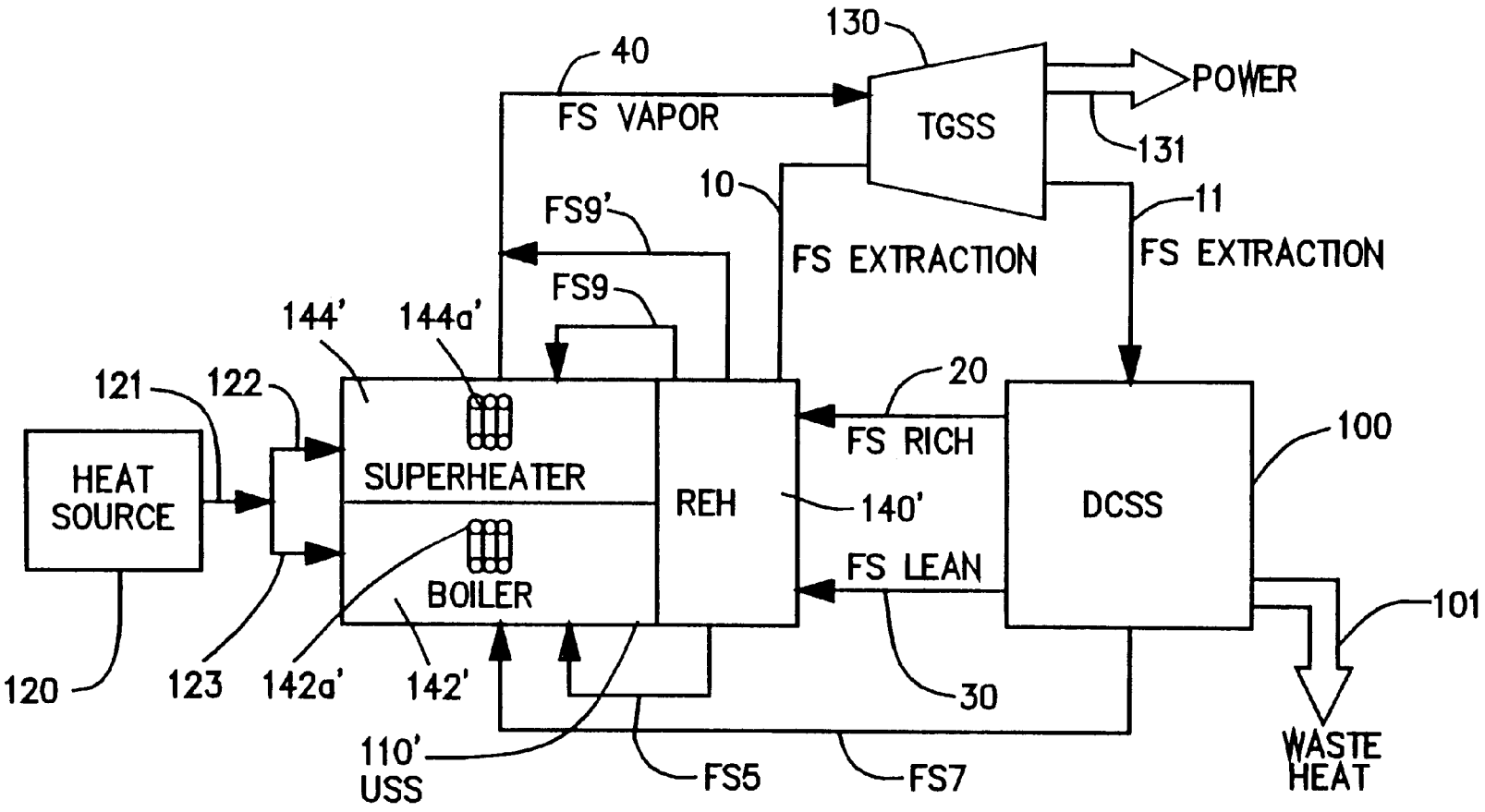
FIG. 6 is a simplified depiction of a Kalina cycle power generation system in accordance with the present invention.

A simplified Kalina cycle power generation system in accordance with the present invention is illustrated in FIG. 6 of the drawings. The Kalina cycle power plant shown is identical to that depicted in FIG. 1, except that the VSS 110' of FIG. 6 is substituted for VSS 110 in FIG. 1. The differences in the VSS 110' will be detailed below. Since the operation of the Kalina cycle power plant shown in FIG. 6 is the same as has been described with reference to FIG. 1, further description of the operation of the depicted power system is deemed to be unnecessary.

Figure 7B:
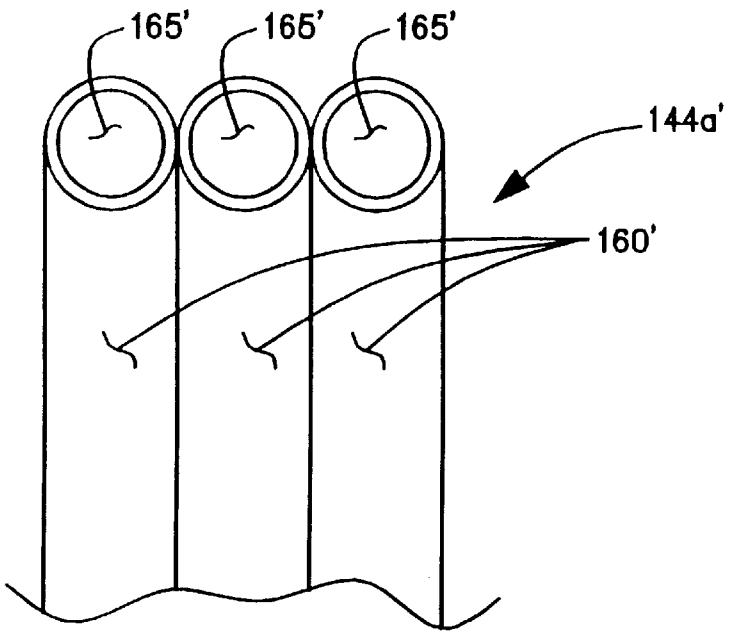
FIG. 7B details the tubular walls of the Kalina cycle superheater shown in FIG. 6.
Figure 7A:
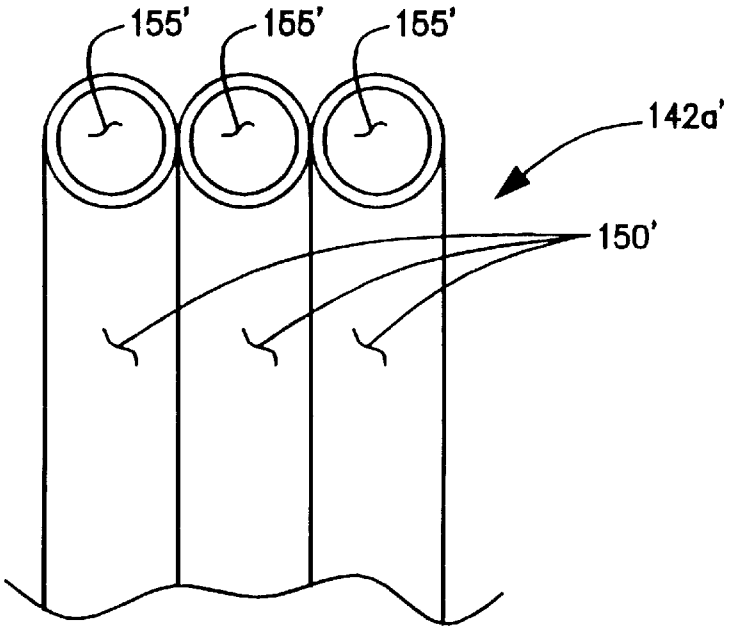
FIG. 7A details the tubular walls of the Kalina cycle boiler shown in FIG. 6.

The VSS 110' includes the boiler 142' and superheater 144' and recuperative heat exchanger (RHE) 140'. The boiler 142' is formed of tubular walls 142*a*' and the superheater 144' is formed of tubular walls 144*a*'. A portion 123 of the process heat 121 is used to vaporize the working fluid in the boiler 142'. Another portion 122 of the process heat 121 is used to superheat the vaporized working fluid in the superheater 144'. FIG. 7A depicts an expanded view of the boiler fluid walls 142*a*' through which the working fluid flows. As shown, the fluid walls 142*a*' are formed of tubes 150' made of low alloy steel having 2½Cr to 16Cr and 1Mo. As is customary in Rankine cycle power systems, the tubes 150 have a mill finish on the inner surfaces 155. FIG. 7B depicts an expanded view of the superheater tubular walls 144*a*' through which the vaporized working fluid flows. As shown, the tubular walls 144*a*' are formed of tubes 160' made of high alloy steel having 18Cr and 8Ni.

Figure 8:
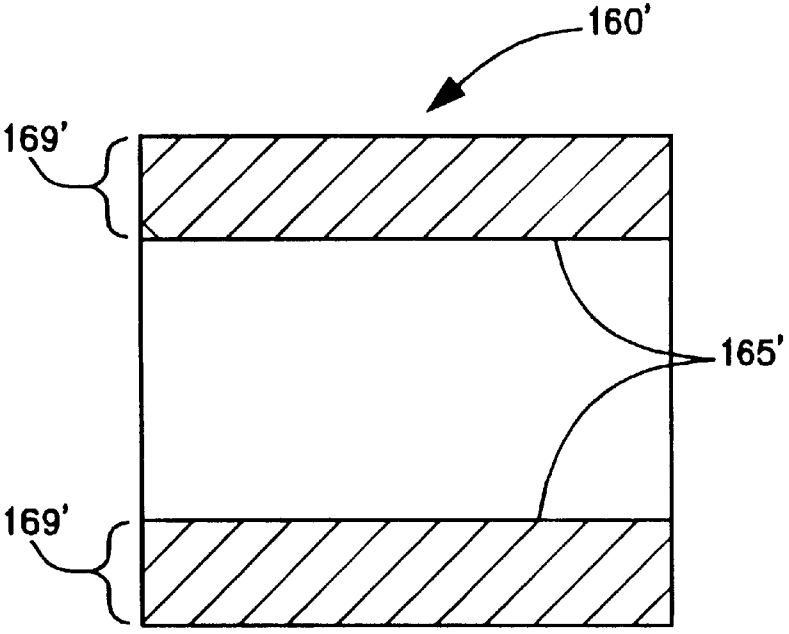
FIG. 8 depicts a cross section of a tube of the superheater tubular wall shown in FIG. 7B, with the internal surface of the tube polished to inhibit nitriding.

FIG. 8 depicts a cross section of the superheater tube 160' of the superheater 144' shown in FIG. 7B. The tube 160' has an inner surface 165' which has been polished. This polishing of the original mill finished surface will inhibit the nitriding of the tubes 160' due to exposure to the high pressure, high temperature vaporized ammonia/water working fluid which flows through the tubular walls 144*a*' of the superheater 144' of the Kalina cycle power system of FIG. 6. The tube, as discussed above, is formed of the austenitic steel having 18Cr and 8Ni. As shown, after being exposed to the ammonia/water working fluid the polished inner surface 165' of the tube 160' remains unattacked. This, as best understood, is because the polishing of the internal surface of the tube 160' inhibits the nitriding of the polished surface 165' of the tube 160'.

Those skilled in the art will recognize that the tube 160' could also be utilized to transport the working fluid in other components of the VSS 110', the TGSS 130 and the DCSS 100. Accordingly, it should be understood that steel tubes, whether formed of austenitic, ferritic or other type of steel, which serve to direct the flow of the working fluid in other areas of the power system of FIG. 6, could also be formed with a polished internal surface to inhibit nitriding and hence the resulting structural degradation of the tube.

Figure 9:
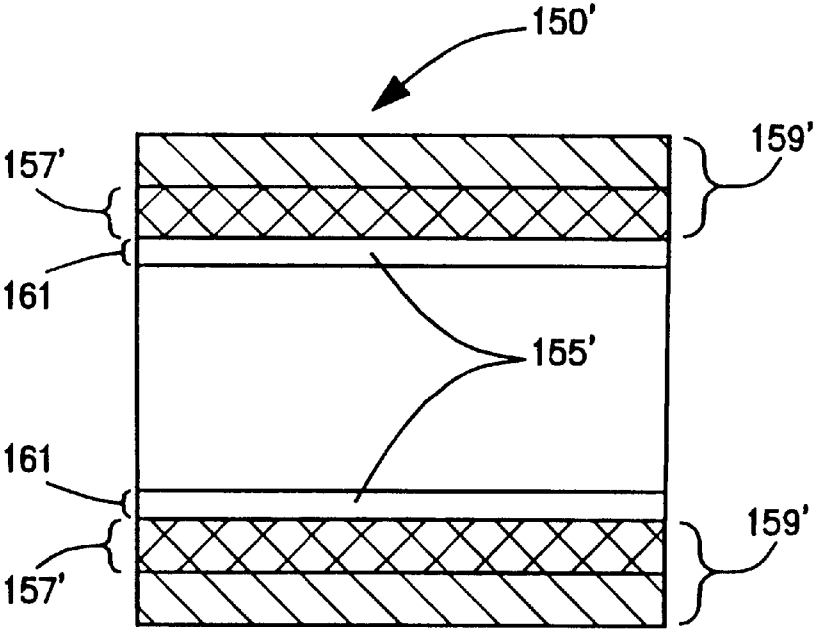
FIG. 9 depicts a cross section of a tube of the boiler tubular wall shown in FIG. 7A, with the inner surface of the tube having an oxide layer formed by the ammonia/steam environment of the type actually found in a Kalina cycle boiler.

As shown in FIG. 9, in the actual operation of a Kalina cycle power system boiler 142', the boiler tube 150', due to the presence of oxygen within the boiler 142', will have an oxide layer 161 formed on the inner surface 155' of the tube wall 159'. This oxide layer 161 will inhibit, and hence lessen, the nitriding which is indicated by layer 157' in FIG. 9.

Figure 10B:
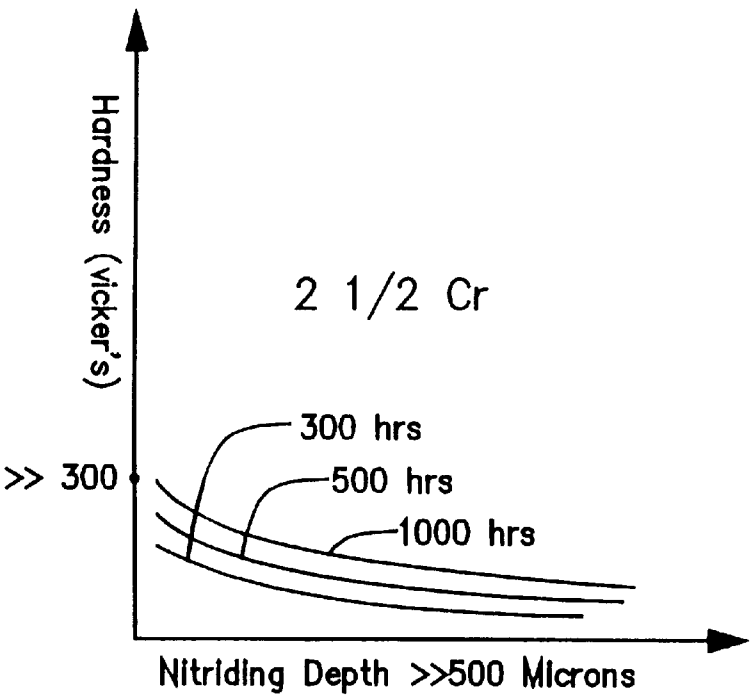
FIG. 10B depicts the depth of the hard layer formed due to nitriding within the wall of a ferritic steel tube having 2½Cr.
Figure 10A:
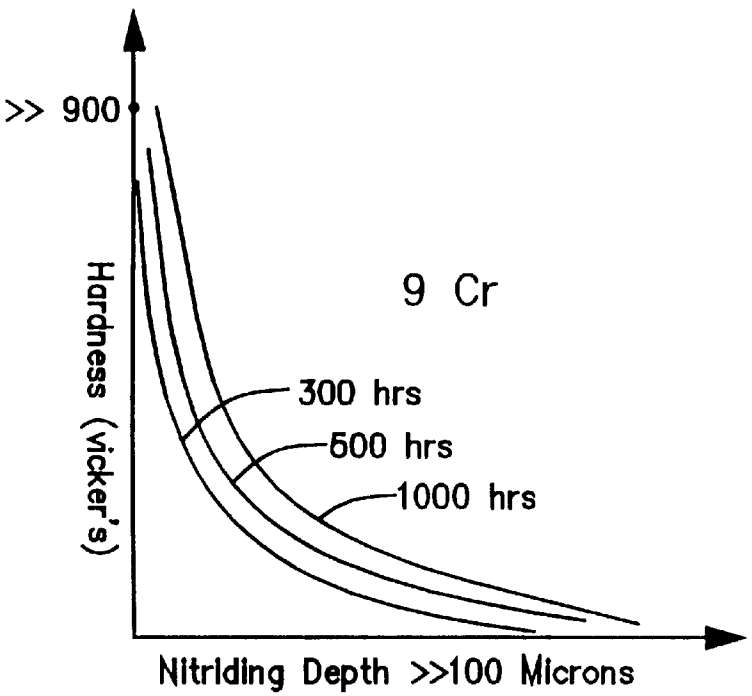
FIG. 10A depicts the depth of the hard layer formed due to nitriding within the wall of a ferritic steel tube having 9Cr.
Figure 11:
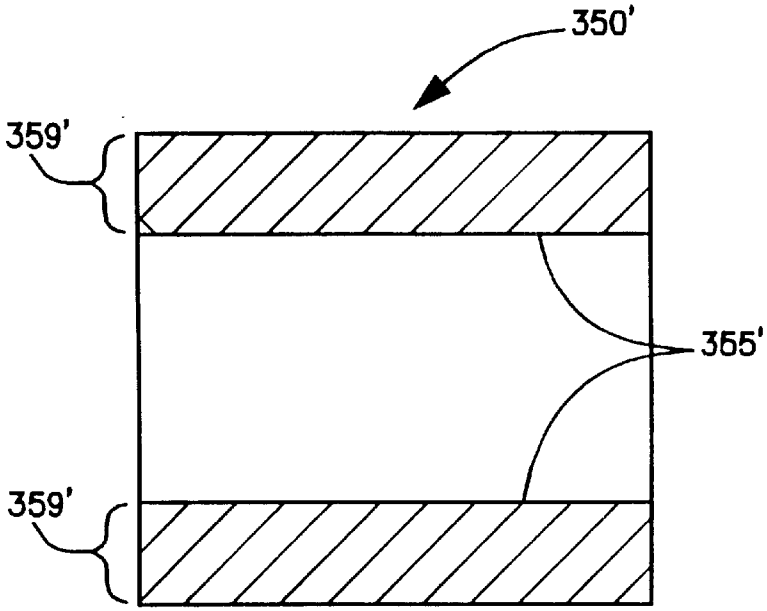
FIG. 11 depicts a cross section of a mild steel tube which can be used to direct the working fluid flow in the Kalina cycle power system shown in FIG. 6, with an inner surface of the tube showing no signs of nitriding caused by an ammonia/steam environment of the type actually found in a Kalina power system.

As shown in FIGS. 10A and 10B, the formation of the oxide layer 161, shown in FIG. 11 on the inner surface of the ferritic steel tube 150', will affect the extent of the structural degradation caused by nitriding in a Kalina cycle power generation system. More particularly, the ingress of the nitrogen into the tube wall 159' shown in FIG. 9 is, as shown in FIGS. 10A–B, inhibited by the oxide layer 161 formed on the wall surface 155' of the tubes 150' of the boiler 142' tubular walls 142*a*'.

With ferritic steel having a chromium content of 9Cr, as indicated in FIG. 10A, and the boiler operating at an approximate temperature of 565° C. and pressure of 180 bar, the hardness and hence brittleness of the nitride layer 157' is limited to approximately 900 Vickers and the depth of the nitride layer after 1000 hours is limited to approximately 100 microns. Thus, a relatively lower hardness nitride layer 157' having a relatively small depth is formed. Such a nitride layer formed in the wall 159' of the tube 150' over such a limited depth indicates that, in a practical Kalina cycle boiler, it is likely that nitriding will not, in general, reduce the structural integrity of the tube to a point that it would be unable to withstand the loading required of the boiler walls.

If the tube is formed of ferritic steel having a chromium content of 2½Cr, as indicated in FIG. 10B, and the boiler operating at an approximate temperature of 565° C. and pressure of 180 bar, the hardness and hence brittleness of the nitride layer 157' is limited to approximately 300 Vickers and the depth of the nitride layer after 1000 hours is limited to approximately 500 microns. Here again, such a nitride layer formed in the wall 159' of the tube 150' over such a limited depth during the test period indicates that nitriding will probably not, in general, reduce the structural integrity of the tube to a point that it would be unable to withstand the required loading of the boiler walls over a typical design life.

Accordingly, ferritic steel of the type commonly used in Rankine cycle boilers, e.g., ferritic steel having 2½–16Cr and 1Mo, are utilized in the Kalina cycle boiler of FIG. 6. Similar oxidation will occur in austenitic steels. Further, because the quality of the oxide layer 161 as a nitriding inhibitor increases with the chromium content of the ferritic or austenitic steel, the type of ferritic steel used in particular areas of the Kalina system is preferably selected based upon, among other factors, the relationship between the chromium content and the desired quality of the oxide layer 161 to be formed, which in turn will determine the amount of nitriding and thus the degradation to the flow tubes. More particularly, the concentration of chromium in, for example, the ferritic steel tubes 150' forming the boiler 142' are selected considering the operating parameters of the boiler and working fluid, such that the quality of the oxide layer 161 will inhibit nitriding to a desired level, both in terms of hardness and depth over the boiler's design life. It should also be recognized that, if desired, the oxide layer 161 could be formed prior to subjecting the tube to the working fluid within the Kalina cycle power system of FIG. 6 to further inhibit nitriding of the tubular walls.

It should also be understood that, because of the effect of the temperature on the oxidation process, i.e., higher temperatures will increase the hardness and depth of the nitriding, ferritic steels are not utilized in the flow tubes of the Kalina cycle system of FIG. 6 which are subjected to temperatures exceeding approximately 600° C., without pre-treating the inner surface of the flow tubes. For example, the pre-treatment could consist of forming an oxide layer on the inner surfaces of the tubes or polishing the inner surfaces of the tubes before the tubes are subjected to the working fluid of a Kalina cycle system. More generally, by pre-treating the ammonia contact surface of a metal member, such as the surfaces forming the flow passages in the ferritic or austenitic steel tubular walls of a Kalina cycle power generation system of FIG. 6, the catalyst, i.e., the metal contact surface, which is necessary for nitriding to occur is reduced, if not eliminated, thereby reducing or eliminating degradation of the metal member due to the effects of nitriding.

FIG. 11 depicts a cross section of a mild steel tube 350' having a tube wall 359' with an inner surface 355' which forms a flow passage for the working fluid in the Kalina Cycle power generation system depicted in FIG. 6. As has been previously described, mild steel tube will typically include traces of chromium which could serve as a catalyst for nitriding when exposed to the binary working fluid of a Kalina cycle power generation system. However, the disassociation of the ammonia which is required for nitriding will lessen as the working fluid pressure increases. That is, the amount of nitrogen formed will become greater and greater as the pressure decreases, and hence, the nitriding will be relatively high at low pressures, e.g., ambient pressure, and relatively low at high pressures, e.g., 100 bar or more.

Accordingly, as shown in FIG. 11, at temperatures and pressures typically found in a Kalina cycle power generation system, no nitriding of the inner surface 355' forming the working fluid flow passage in the tube 350' will occur. Accordingly, a mild steel tube may be utilized to form the flow passages within the DCSS 100, RHE 140 and other components of the Kalina cycle shown in FIG. 6. Hence, for operating temperatures between 100° C. and 500° C. and pressures between 100 bar and 180 bar, as might be experienced in a typical Kalina cycle power generation system, mild steel flow tubes can be utilized.

Figure 12:
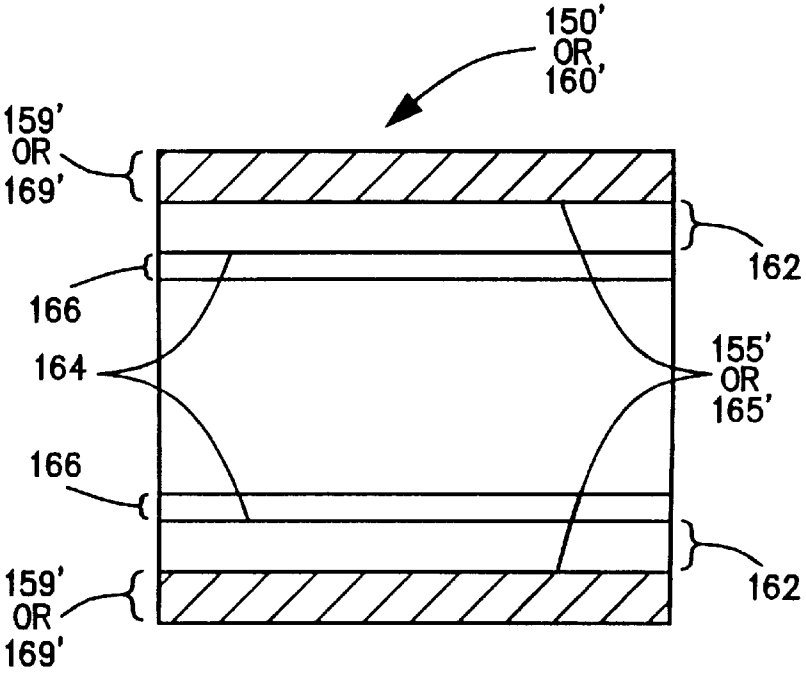
FIG. 12 depicts a cross section of a steel tube of a tubular wall shown in FIG. 6, with the inner surface of the tube having a chromium layer to protect against nitriding in a Kalina cycle power system.

FIG. 12 depicts a superheater or boiler tube 150' or 160', which can be formed of either mild, ferritic or austenitic steel and used within the tubular wall 142*a*' or 144*a*' of the VSS 110' or elsewhere in the Kalina cycle system of FIG. 6. The tube wall 159' or 169' having an inner surface 155' or 165' defines a flow passage for the binary working fluid of the FIG. 6 Kalina cycle power generation system. As shown in FIG. 12, the tube wall surface 155' or 165' is coated with a material having a high concentration, preferably between 30 and 50%, of chromium thereby forming a chromium-rich layer 162 on the inner wall surface of the tube 150' or 160'. The binary working fluid, therefore, contacts the surface 164 of the chromium layer 162. This high concentration, i.e., chromium-rich layer 162 will inhibit, if not all together prevent, the nitriding of the tube wall 159' or 169' even at temperatures above 565° C. and pressures of 180 bar. Further, even at such higher temperatures and lower pressures, where the extent of nitriding and hence the degradation of the structural integrity of the tube 150' or 160' would otherwise be unacceptedly increased, the chromizing of the surface 155' or 165' of the tube 150' or 160' with the chromium layer 162 substantially decreases the rate of nitriding and hence the rate of degradation of the flow tube 150' or 160' up to temperatures of 650° C. at 180 bar pressure. Further, the chromium layer provides an additional margin for inhibiting nitriding at lower pressures, i.e., pressures below 180 bar. Referring again to FIG. 12, as shown, after being subjected to a nitriding solution such as the binary working fluid of the Kalina cycle power generation system of FIG. 6, an oxide layer 166 will form on the surface 164 of the chromium layer 162. This oxide layer, as has been previously described, will also serve as a nitriding inhibitor. As discussed above, the oxide layer can be formed during operation of the Kalina cycle power generation system of FIG. 6 or could be pre-formed by subjecting the tube 150' or 160' to oxygen prior to subjecting the tube 150' or 160' to the working fluid of the FIG. 6 Kalina cycle power generation system.

As described in detail above, the present invention provides a technique for avoiding the unacceptable degradation of steel components exposed to an ammonia/steam environment due to nitriding, including steel components of power systems, such as the tubular walls in a Kalina cycle type power system. Further, the invention can be used to select steel power system components, such as flow tubes in a Kalina cycle type power system, so that unacceptable degradation of the components due to nitriding is avoided.

What is claimed is:

1. A system for transferring heat to a working fluid, including ammonia, comprising:

a working fluid source configured to direct a flow of a working fluid which includes ammonia and has a temperature; and a plurality of steel tubes, each tube having a flow passage defined by a treated inner surface, configured to receive the working fluid from the source and to direct the flow of the received working fluid along a path exposed to heat to increase the temperature of the received working fluid.

2. A system according to claim 1, wherein:

the plurality of tubes is formed of an alloy steel.

3. A system according to claim 2, wherein:

the plurality of tubes is formed of one of ferritic steel and austenitic steel.

4. A system according to claim 1, wherein:

the plurality of tubes is formed of steel having a chromium content of up to 18Cr.

5. A system according to claim 1, wherein:

the plurality of tubes form one of a boiler and a superheater; and the plurality of tubes are configured to transfer the heat to the received working fluid to increase the temperature of the received working fluid.

6. A system according to claim 1, wherein:

the treated inner surface of each tube is formed by polishing a mill finished surface of each of the plurality of steel tubes.

7. A system according to claim 1, wherein:

the plurality of steel tubes is a first plurality of steel tubes formed of austenitic steel;

the temperature is a first temperature;

the working fluid source includes a second plurality of steel tubes formed of other than austenitic steel, each tube having a flow area defined by an inner surface thereof, configured to receive the working fluid in a liquid state and to direct the flow of the received working fluid along a path exposed to heat to increase a temperature of the received working fluid to the first temperature and thereby cause the received working fluid to vaporize; and the first plurality of tubes is configured to receive the vaporized working fluid and to direct the flow of the vaporized working fluid to increase a temperature of the vaporized working fluid to a second temperature which is greater than the first temperature to thereby cause the vaporized working fluid to be in a superheated condition.

8. A system according to claim 7, further comprising:

a turbine configured to receive the superheated vaporized working fluid and to expand the superheated vaporized working fluid to generate power.

9. A system according to claim 1, wherein:

the system is a Kalina cycle power generation system; and the working fluid is a binary working fluid formed of ammonia and steam.

10. A system according to claim 1, wherein the temperature of the working fluid is increased to a temperature exceeding 500° C.

11. A system according to claim 10, wherein the pressure of the working fluid at the increased temperature exceeds 100 bar.

12. A system for transferring heat to a working fluid, including ammonia, comprising:

a working fluid source configured to direct a flow of a working fluid which includes ammonia and has a temperature; and a plurality of steel tubes, each tube having a flow passage defined by an oxidized inner surface of the tube, configured to receive the working fluid from the source and to direct the flow of the received working fluid along a path exposed to heat to increase the temperature of the received working fluid.

13. A system for transferring heat to a working fluid, including ammonia, comprising:

a working fluid source configured to direct a flow of a working fluid which includes ammonia and has a pressure substantially greater than ambient pressure; and a mild steel flow tube, having an inner surface defining a flow passage, configured to receive the working fluid from the source and to direct the flow of the received working fluid along a path.

14. A system for transferring heat to a working fluid, including ammonia, comprising:

a working fluid source configured to direct a flow of a working fluid which includes ammonia and has a temperature; and a plurality of steel tubes, each tube having a flow passage defined by a chromized inner surface of the tube, configured to receive the working fluid from the source and to direct the flow of the received working fluid along a path exposed to heat to increase the temperature of the received working fluid.

15. A system for changing the temperature of a working fluid, including ammonia, comprising:

a working fluid source configured to direct a flow of a working fluid, including ammonia, at a temperature; and a steel tube, having a treated inner surface defining a flow passage, configured to receive the working fluid from the source and to direct the flow of the received working fluid along a path to change the temperature of the received working fluid.

16. A system according to claim 15, wherein:

the treated inner surface includes a chromium layer.

17. A system according to claim 16 wherein:

the chromium layer has a chromium concentration of at least 30% and no more than 50%.

18. A system according to claim 15, wherein:

the treated inner surface is a polished inner surface.

19. A system according to claim 15, wherein:

the treated inner surface is an oxidized inner surface.

20. A Kalina cycle power generation system, comprising:

a plurality of steel tubes configured to heat a binary working fluid including ammonia, each of the plurality of tubes having a treated surface for contacting the binary working fluid and for defining a flow passage for directing a flow of the binary working fluid; and a turbine for receiving the heated binary working fluid from the plurality of tubes and expanding the received heated binary working fluid to generate power.

* * * * *